United States Patent [19]

Schlueter

[11] Patent Number: 4,691,602

[45] Date of Patent: Sep. 8, 1987

[54] PUNCH AND EJECTOR ASSEMBLY

[76] Inventor: Edward Schlueter, 61 Norton Dr., East Northport, N.Y. 11731

[21] Appl. No.: 301,951

[22] Filed: Sep. 14, 1981

[51] Int. Cl.[4] ..... B26D 7/18

[52] U.S. Cl. ..... 83/128; 30/130; 30/368; 83/140; 83/143

[58] Field of Search ..... 83/140, 128, 143, 117, 83/698, 700; 30/130, 358, 368

[56] References Cited

U.S. PATENT DOCUMENTS

| | | | |
|---|---|---|---|
| 115,157 | 5/1871 | Brown et al. | 30/130 X |
| 389,404 | 9/1888 | O'Neill | 83/698 X |
| 1,940,438 | 12/1933 | Stowell | 30/130 X |
| 2,545,237 | 3/1951 | Maby | 30/130 |
| 3,063,319 | 11/1962 | Johnson | 83/698 X |
| 3,190,160 | 6/1965 | Armacost | 83/128 |
| 3,222,968 | 12/1965 | Larson | 83/128 |
| 3,379,083 | 4/1968 | Burns et al. | 83/700 X |
| 3,459,081 | 8/1969 | Kanode | 83/140 |
| 3,504,436 | 4/1970 | Ebert | 30/358 |
| 3,620,113 | 11/1971 | Gargrave | 83/140 |

FOREIGN PATENT DOCUMENTS

| | | | |
|---|---|---|---|
| 163914 | 9/1949 | Austria | 83/128 |
| 484259 | 9/1953 | Italy | 83/128 |
| 21797 | of 1903 | United Kingdom | 83/128 |

OTHER PUBLICATIONS

Marks' Standard Handbook for Mechanical Engineers, 8th Edition, McGraw-Hill Book Co., N.Y., pp. 8-77.

*Primary Examiner*—Robert L. Spruill
*Assistant Examiner*—Steve Katz
*Attorney, Agent, or Firm*—Marvin Bressler

[57] ABSTRACT

A piercing punch and ejection assembly has a piercing punch member provided with a bore in its point thickness section. The ejector member, included in the assembly, comprises a conical helical spring of rectangular cross section that is installed into the blind hole bore of the punch member.

7 Claims, 5 Drawing Figures

PUNCH AND EJECTOR ASSEMBLY

BACKGROUND OF THE INVENTION

1. Field of the Invention

The instant invention is directed to a piercing punch and ejector assembly. More particularly, the instant invention is directed to a piercing punch and ejector assembly charaterized by increased operating life, reduced downtime and maintenance requirements and simpler design than the assemblies of the prior art.

2. Description of the Prior Art

Piercing punch and ejector assemblies are fundamental tools employed in the machining and material forming arts. These assemblies include a piercing punch member which cuts out a slug or blank and an ejecting means member which insures that the cut out slug or blank does not adhere to the cutting edge face of the piercing punch member.

Typically, piercing punch and ejector assemblies have included a spring actuated ejecting pin disposed in a bore provided in the point thickness section, or beyond, of the piercing punch member. A spring, situated in a counterbore in the body and shoulder thickness sections of the punch member, urges the ejection pin outward beyond the surface of the cutting edge of the punch member.

Although these designs function to punch slugs or blanks from working stock they present important design, operation and maintenance problems to workers in this art. This has resulted in the development of improved designs to overcome these perceived defects. However, these designs still retain an ejection pin. Since, there are certain inherent limitations in the utilization of spring activated ejector pins, no number of design changes can completely overcome these shortcomings.

One of these design limitations is the requirement that the bore and counterbore, required to accommodate the ejection pin, the spring and additional means necessary to hold the pin and spring in place, i.e., a set screw, a collar and the like, extends longitudinally from one end of the punch member to the other, from the cutting edge to the top of the shoulder. This "through hole" effectively makes the piercing punch member a tubular instrument. Obviously, a tubular punch is a weaker tool than the same punch constructed substantially solid. This defect is even further accentuated by the larger diameter counterbore employed to accommodate all ejector means constituents other than the ejector pin. The result of this design flaw is a punch member having a shorter working life than the same piercing punch member having a more solid construction.

Although of lesser significance, the above discussion suggest a secondary disadvantage of the through hole design of the prior art. That is, this design requires the machining of a pair of holes, a bore of smaller diameter, and a counterbore of larger diameter. This design requirement adds complexity and expense to the manufacture and cost of the piercing punch member.

Another limitation of the typical piercing punch and ejector assembly of the prior art is the difficulty associated with disassembly of the ejector means during the periodic sharpenings of the cutting edge of the piercing punch member. This periodic sharpening is necessary to extend the life of the punch member. During this sharpening the ejector means, disposed in the bore and counterbore of the punch member, is removed. The removal and reinsertion of the ejector means requires total disassembly of the punch and die apparatus in that access to the counterbore end of the punch is required.

It is appreciated that ejector pin designs have been advanced that eliminate much of the difficulty involved in removal of the ejector means. Specifically, ejector pin designs have been developed in which only the ejector pin is removed, and thereafter reinstalled, during sharpening. In other designs, the ejector pin is held in the retracted position during sharpening. However, to provide this simplification in maintenance, a complex ejector means design must be employed. This adds significant complexity and cost to the punch and ejector assembly. Thus, the use of an ejector pin in a piercing punch and ejector assembly requires time consuming and labor intensive maintenance cost or, in the alternative, a highly complex and expensive design.

The complexity and expense of typical through hole designs is also evidenced by the need of these designs of the prior art to include a hole disposed normal to the bore or counterbore that provides venting. Without going into detail, suffice it to say, that the ejecting means employed in through hole designs create vacuum effects at the cutting edge of the punch member which requires this expensive remedy. Of course, the absence of such an expedient results in operating malfunctions resulting from the cut out blank adhering to the punch due to this vacuum effect.

A related problem, associated with the sharpening of piercing punch members, in the prior art is the limitation on the number of times the punch member may be rehoned before the punch member is discarded. Each time the punch member is resharpened its length is correspondingly decreased. Although this has no adverse effect on the typical ejector pin design in the unrestrained position, since it only causes the pin to extend further beyond the cutting edge surface, it has a very deleterious effect on the punch and ejector assembly in the retracted position. After enough resharpenings there is an insufficient length of bore to accommodate the ejector pin when the ejector means spring is compressed and the ejector pin retracted. Since ejector pins are manufactured in standard lengths, a new shorter pin cannot replace the original longer pin with the result that the whole assembly must be replaced.

In summary, the piercing punch and ejector assemblies of the prior art suffer from limitations in terms of their strength of construction, their difficult and time consuming maintenance requirements or complex and expensive design, and their limited effective working life.

BRIEF SUMMARY OF THE INVENTION

The instant invention is directed to a new piercing punch and ejector assembly which provides improved strength of construction, a simplified design which provides simplified and less time consuming maintenance and longer effective useful life. This is all accomplished in an improved assembly that employs a blind hole eliminating the through hole design of the prior art and that eliminates the need for an ejection pin which simplifies maintenance, decrease the cost of both the punch member and the ejection means and increases assembly working life.

In accordance with the present invention a piercing punch and ejector assembly is provided. It comprises a piercing punch member having a point thickness section provided with a longitudinal bore. An ejector member is also provided. It includes a conical helical spring of rectangular cross section disposed in said bore.

BRIEF DESCRIPTION OF THE DRAWINGS

The instant invention may be better understood by reference to the accompanying drawings of which.

DETAILED DESCRIPTION

Figure 1:
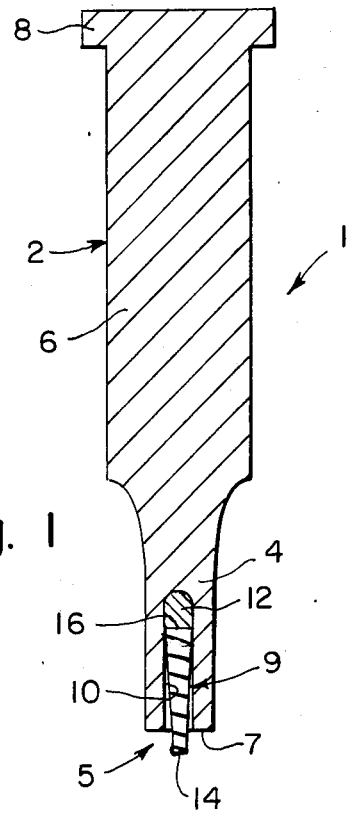
FIG. 1 is a longitudinal cross sectional view of a preferred embodiment of the piercing punch and ejector assembly of this invention.

Turning now to the drawings in detail, a preferred embodiment of the piercing punch and ejector assembly of this invention is generally indicated at 1. The assembly 1 includes a piercing punch member depicted generally at 2. The piercing punch member 2 comprises a point thickness section 4, a body thickness section 6 and a shoulder thickness section 8.

The punch member 2 is characterized by a blind hole provided therein. The term "blind hole" is used to emphasize the fact that a bore 10 is provided only in the point thickness section 4 of the punch member 2. That is, an opening 10 extending from the cutting edge surface 7 upwards as high as the top of the point thickness section 4 of the member 2 is provided.

It is noted that the point thickness section 4 is that portion of the piercing punch member 2 having a thickness, most often a diameter, equal to the thickness of the cutting edge 7. Similarly the body thickness section 6 disposed above and integral with the point thickness section is characterized by a uniform thickness equal to that of the bulk of the punch member 2. The shoulder thickness section 8 is that uppermost section of the punch member 2 wherein the thickness is greatest defining the shoulder of the punch 2. The section 8 is integral with the point and body thickness sections, 4 and 6. The body and shoulder sections 6 and 8 are characterized by a solid shape since the bore 10 extends only within the point thickness section and there is no counterbore.

A unique feature of the assembly 1 is the inclusion of a plug or core 12 placed at the end of the bore 10 remote from the cutting edge surface 7. Whereas the punch member 2 is constructed of a hard metal, well known to those skilled in the art, the core 12 is formed of an easily drilled, soft material. Among the materials that can be used as the material of construction of the core 12 are aluminum, copper, cold rolled steel and plastics. Of these aluminum is particularly preferred.

The use of the core 12 provides the important advantage of extending the life of the punch member 2. Typically, the cutting edge 7 of the punch member 2 is periodically resharpened to extend the useful life of the punch. Although this expedient extends the punch life, the number of times such a procedure can be repeated is limited. When the repeated sharpenings diminish the bore 10 length to the extent that the ejector member (to be described below) cannot fully retract therein, the punch member 2 must be replaced. This is because the punch member 2 is constructed of a very hard metal, necessary to prevent structural failure during its operation. Thus, it is exceedingly difficult to drill into such a metal to extend the length of the bore 10.

The design of the piercing punch member 2 provided with the core 12 overcomes this problem. Obviously, it is quite simple to drill into the soft material core 12 resulting in an extension in the number of tixes the cutting edge 7 can be rehoned. It is important to appreciate that this method increases the number of times the punch member 2 can be resharpened without diminishing its structural strength. This is because the bore length need not ever be increased beyond its original length. The bore 10 need only be increased, by decreasing the length of the core 12 after continued sharpenings, to its original length.

Figure 3:
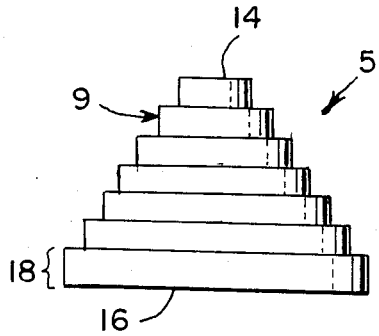
FIG. 3 is a front elevational view of the conical helical spring of this invention.

The piercing punch and ejector assembly 1 includes an ejector means, generally indicated at 5. The ejector means 5 comprises a conical helical spring of rectangular cross section 9. The conical helical spring 9 is best depicted in FIG. 3. As seen in FIG. 3, the spring has an ever increasing diameter, resulting in a cone shaped appearance. In the drawings the small diameter end is denoted 14 and the opposite end, the large diameter end is denoted 16. A conical helical spring of rectangular cross section is particularly suited to this application. Unlike most forms of springs, this type spring can be squeezed. Thus, its maximum diameter, i.e., end 16, can exceed the diameter of the bore 10 and yet be capable of being placed into the bore 10. This permits the spring 9 to be held in the bore 10 without any holding means to anchor it in the bore 10. The spring action of the helical spring 9 holds the spring 9 firmly in the bore 10. Equally important, the absence of holding means eliminates the need for a counterbore, which in prior art designs is included to accommodate said holding means. This, in turn, eliminates the tubular design piercing punch, typical of many prior art designs, which include a through hole.

The conical helical spring of rectangular cross section 9 is additionally characterized by its ability to fold into itself such that its length can be reduced to that of its width, illustrated in the drawings at 18. The ability of the spring 9 to decrease its thickness to this significant degree, without adversely affecting its spring power imparts another significant advantage to the punch and ejector assembly 1. Because the ejector means length can be decreased the bore 10 can also be proportionately decreased without any deleterious effect. Therefore, the cutting edge surface 7 of the punch member 2 can be resharpened many times, even to the point of decreasing the length of the point thickness section 4, and hence, the length of the bore 10, without adversely affecting the operation of the assembly 1. Indeed, the bore 10 may be as short as the width 18 of the spring 9 and the assembly 1 will still function, since the retracted spring 9 will still be accommodated in the bore 10. This feature adds yet further useful life to the assembly even before the improved feature provided by the core 12 is put into effect.

Figure 4:
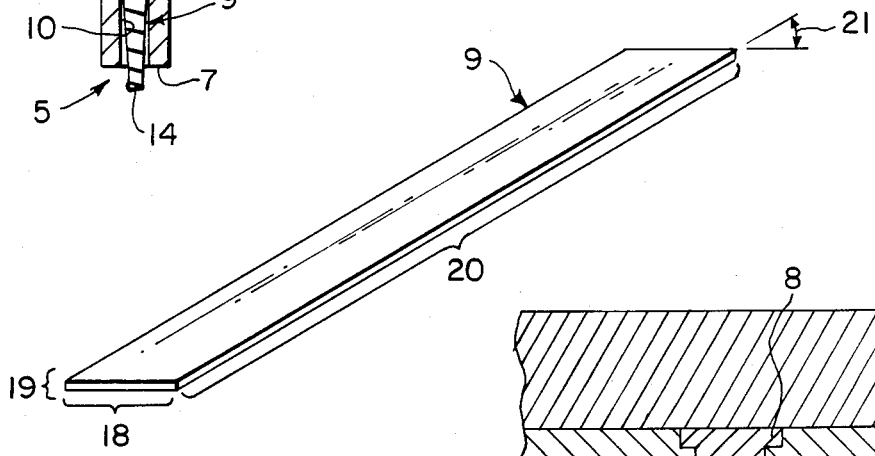
FIG. 4 is a flat pattern isometric view of the spring of FIG. 3.

The conical helical spring of rectangular cross section 9 is shown in a flat pattern view in FIG. 4. Its width 18 and thickness 19 defines its rectangular cross section. Its length 20 and helical angle 21 defines the shape of the cone depicted in FIG. 3. The material of construction of the spring 9 is most preferably a hard metal. Among the hard metals preferred for employment in this application are stainless steel, carbon steel, beryllium copper and phosphorus bronze.

Figure 5:
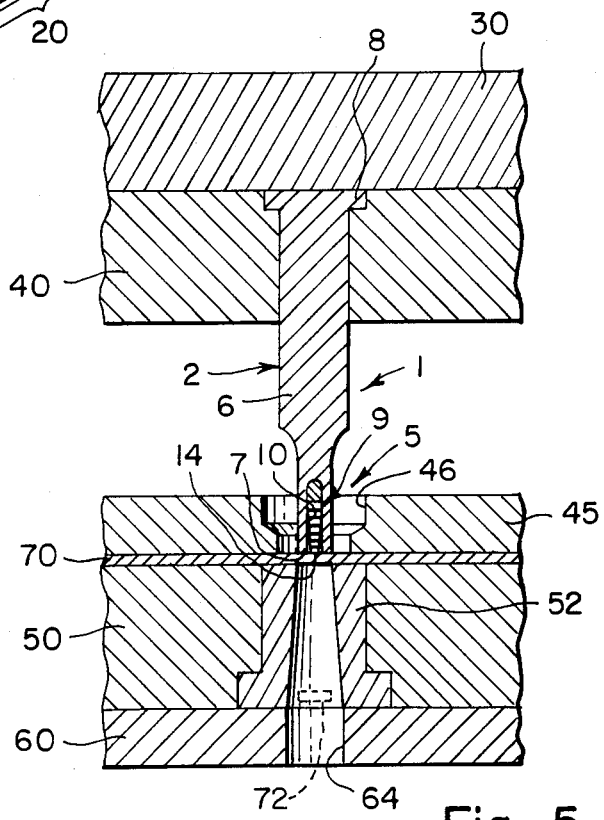
FIG. 5 is a longitudinal cross sectional view of the punch and ejector assembly in operation.

As illustrated in FIG. 5, the piercing punch and ejector assembly 1, in a preferred embodiment, is held in a punch shoe 30 and punch retainer 40. The shoe 30 and retainer 40 are secured together by conventional means well known to those skilled in the art (not shown). A die retainer 50 and a die shoe 60, also secured together by conventional means (not shown), are in vertically aligned, spaced relationship with the punch shoe 30 and retainer 40 disposed thereabove. A die insert 52 is accommodated in the die retainer 50 as shown in the drawing. An opening 64 is cut into the die shoe 60 in vertical alignment with the punch member 2 and the die insert 52. A stripper plate 45 is located intermediate the punch retainer 40 and die retainer 50 and in vertical alignment therewith. The stripper plate 45 includes an opening 46 to permit movement of the punch member 2.

Figure 2:
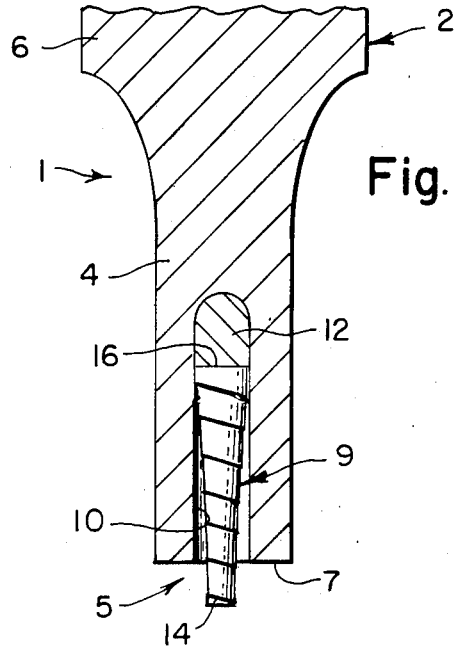
FIG. 2 is a detailed longitudinal cross sectional view of a portion of the assembly of FIG. 1.

In operation, the material from which the plugs or blanks will be formed, the stock 70, is disposed upon the die retainer 50. As shown in FIG. 5, it is impacted by the cutting edge 7 of the punch member 2 which simultaneously compresses and retracts the spring 9 into the bore 10 such that the small diameter end 14 of the spring 9 is flush with the cutting edge surface 7 at the point of impact. The conical helical spring 9 remains in this retracted position until the punched out material, the plug or blank 72 is cut from the stock 70. The blank 72 is depicted in FIG. 5 in dotted line falling in the passageway formed by the opening in the die insert 52 and the opening 64 in the die shoe 60. After impact the compressive force on the spring 9 is removed and the conical spring 9 expands to the position shown in FIGS. 1 and 2. The expansion of the spring 9 to its equilibrium position provides the ejecting force in the event that the blank 72, for any reason, sticks to the cutting edge surface 7 of the punch member 2. The spring 9 dislodges the blank 72 from the cutting edge surface 7 insuring that the continuous operation of punching procedure is uninterrupted.

The above preferred embodiment is given to illustrate the scope and spirit of the instant invention. Other preferred embodiments, within the scope and spirit of this invention, are within the contemplation of the instant invention. The present invention, therefore, should be limited only by the appended claims.

What is claimed is:

1. A piercing punch and ejector assembly comprising:

a piercing punch member having a point thickness section, said section provided with a longitudinal bore; and an ejector member comprising a conical helical spring of rectangular cross section capable of being folded such that its length is reduceable to that of its width.

2. An assembly in accordance with claim 1 wherein said conical helical spring of rectangular cross section is fabricated of a metal selected from the group consisting of stainless steel, carbon steel, beryllium copper and phosphorous bronze.

3. An assembly in accordance with claim 1 wherein said spring extends beyond the cutting edge surface of said punch member in its equilibrium, non-retracted state.

4. An assembly in accordance with claim 3 wherein said piercing punch member includes:

a body thickness section, integral with and, disposed above said point thickness section; and a shoulder thickness section, integral with and, disposed above said body thickness section;

said body thickness and shoulder thickness sections characterized by a solid shape.

5. An assembly in accordance with claim 1 including a core of a soft material disposed at the end of said bore remote from the cutting edge surface of said punch member.

6. An assembly in accordance with claim 5 wherein said soft material is selected from the group consisting of aluminum, copper, cold rolled steel and plastics.

7. An assembly in accordance with claim 6 wherein said soft material core is aluminum.

* * * * *